United States Patent [19]

Uppgren

[11] Patent Number: 4,787,435

[45] Date of Patent: Nov. 29, 1988

[54] CORE BOX ASSEMBLY WITH WEAR STRIP

[75] Inventor: John J. Uppgren, St. Paul, Minn.

[73] Assignee: FMC Corporation, Chicago, Ill.

[21] Appl. No.: 591,251

[22] Filed: Mar. 20, 1984

Related U.S. Application Data

[63] Continuation of Ser. No. 340,403, Jan. 18, 1982, abandoned.

[51] Int. Cl.[4] ..... B22C 13/12

[52] U.S. Cl. ..... 164/228

[58] Field of Search ..... 164/228–334

[56] References Cited

U.S. PATENT DOCUMENTS

| | | | |
|---|---|---|---|
| 1,384,391 | 7/1921 | Krause | 217/5 |
| 1,587,331 | 6/1926 | Kanter | 217/5 |
| 1,836,977 | 12/1931 | Laukel | 164/228 |

*Primary Examiner*—Kuang Y. Lin

*Attorney, Agent, or Firm*—H. M. Stanley; R. C. Kamp; R. B. Megley

[57] ABSTRACT

A core box assembly includes an outer aluminum box containing an inner plastic or wooden mold section having a core depression therein adapted to receive mold sand. A strike-off surface on the box and mold section surrounds an opening providing access to the core depression. A peripheral portion of the strike-off surface is removed so that a step is formed around the periphery of the aluminum box. A portion of flat steel plate is formed with a centrally disposed opening therethrough and is fixed on the assembly with its upper surface in the plane of the strike-off surface, its outer boundary coincident with the outer boundary of the aluminum box, and its inner boundary abutting the step.

9 Claims, 2 Drawing Sheets

FIG_1
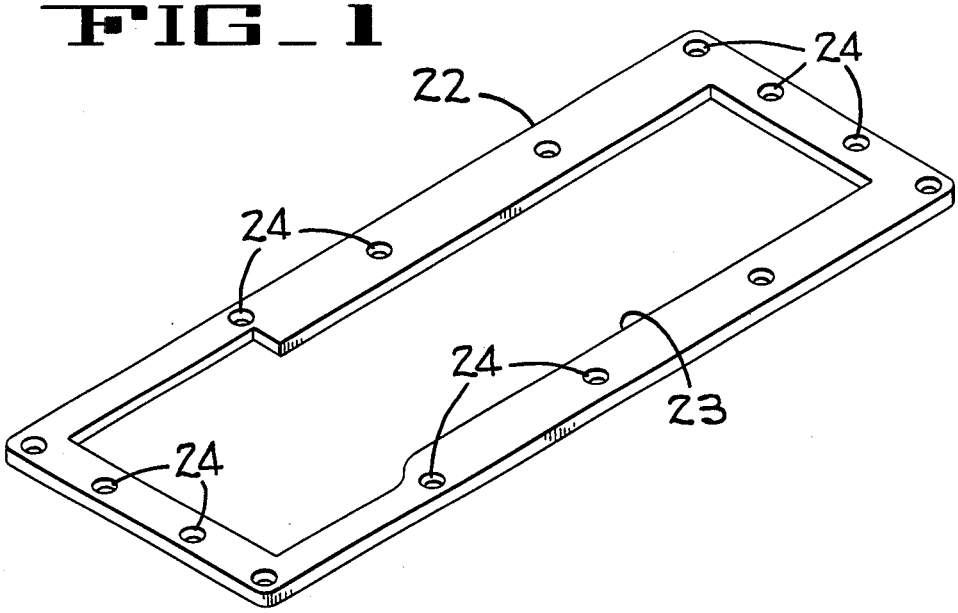
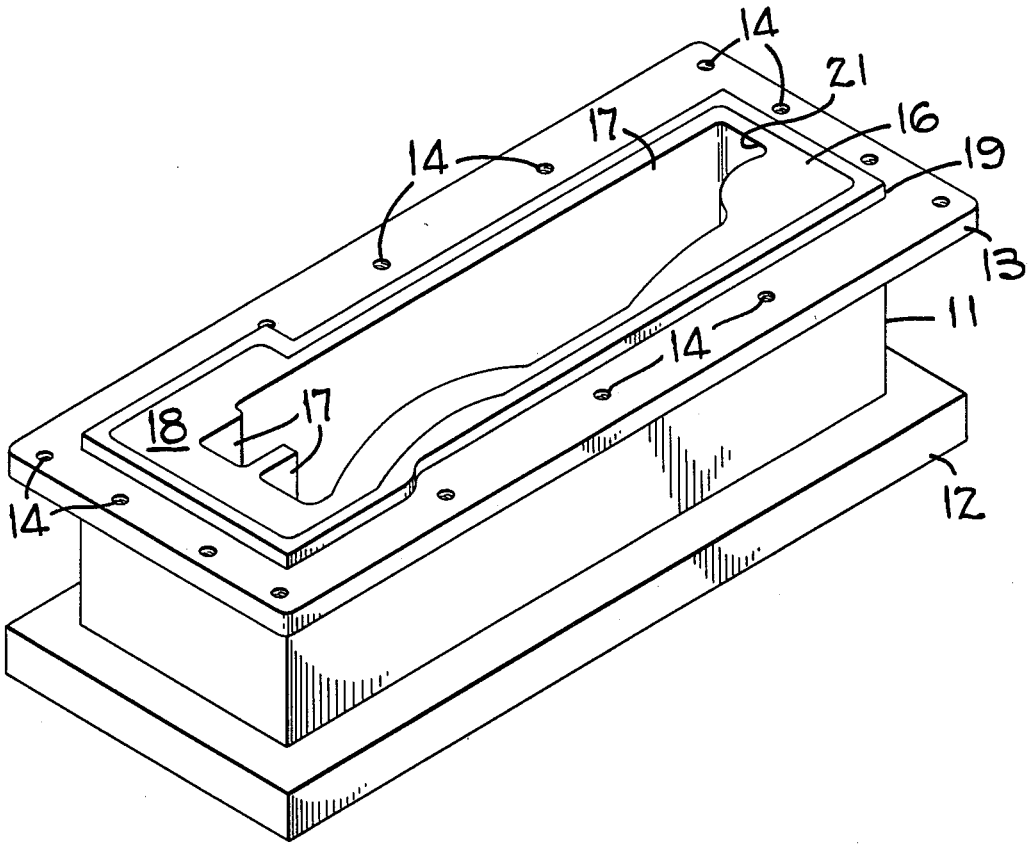
FIG_2

CORE BOX ASSEMBLY WITH WEAR STRIP

This application is a continuation of application Ser. No. 340,403, filed Jan. 18, 1982, and now abandoned.

BACKGROUND OF THE INVENTION

1. Field of the Invention

This invention relates to the foundry arts, and more particularly to that area of the foundry arts related to core box assemblies and the construction thereof.

2. Description of the Prior Art

Core boxes surround a void having inner surface walls in the configuration of the outer walls of a core which is formed therein of some mold material. The formed core is placed within a mold assembly into which a liquid casting material is then poured. The casting material will ultimately solidify and provide a cast article taking the shape of the mold. Cores may be used for example when the desired end cast article has a passage therethrough. In such a case, the core is formed in the core box in the shape of the passage and is laid within the mold so that when the liquid casting material (such as molten metal) is poured into the mold, that volume within the mold occupied by the core is maintained free of metal and the passage therefore appears in the end cast article. An example of such a core may be seen in copending U.S. patent application Ser. No. 238,905, filed Feb. 27, 1981. Cores are therefore generally used as part of a mold assembly to fill volumes within the mold cavity so that the ultimate shape of the cast article is attained.

Such cores for metal casting molds are generally made of a mold sand and bonding agent mixture which is poured into a core box having walls defining the core shape as noted hereinbefore. The core box sometimes defines only one portion, such as one side, of the total shape, there being a matching core box to define the opposite side of the core shape. This is not always the case, since the core may in some instances be made entirely within the one core box. So that the two core parts will properly fit together after they are cured when there are two or more parts to one core, the core depression in the core box is overfilled with the mold sand and then leveled at the top surface of the core box (the strike-off surface) by passing a straight strike-off bar across the core box strike-off surface. The mold sand and bonding agent is abrasive and each time the strike-off bar is passed across the strike-off surface these materials tend to abrade and erode the strike-off surface. In time, it may be seen, that a sufficient amount of the strike-off surface may be removed from the core box by this abrasion that the core depression may become shallower with respect to the strike-off surface. This dimensional error is doubled when the core is formed in two portions, one core box for defining each of the opposite sides of the core. The cores may therefore tend to become smaller and smaller in the dimension corresponding to the depth of the core box so that ultimately the voids in the end cast article (such as a passage through a valve body) become so small that either machining is required to open the passage to acceptable dimensions or new core boxes must be constructed. Either of these two mentioned operations is expensive and time consuming adding to the ultimate cost of the end cast article. Alternatively the end cast articles are provided in a form such that they are dimensionally incorrect.

SUMMARY OF THE INVENTION

A core box assembly includes a core box fabricated of a relatively soft material and having an upper strike-off surface. A core depression having a predetermined shape is formed in the core box so that it may receive a quantity of mold sand therewithin. The intersection of the core depression and the strike-off surface defines a mold opening at the strike-off surface. A recess is formed in the strike-off surface surrounding and displaced from the edges of the mold opening. A continuous strike-off member fabricated of a relatively hard material is formed to fit within the recess. The strike-off member therefore surrounds the mold opening and lies substantially flush with the strike-off surface. In this fashion mold sand may be leveled at the mold opening with a strike-off bar which is guided by the upper surface of the strike-off member and erosion of the strike-off surface on the core box is substantially eliminated.

BRIEF DESCRIPTION OF THE DRAWINGS

FIG. 1 is an isometric view of a wear member included in the present invention.

FIG. 2 is an isometric view of a core box configured in accordance with the present invention.

DESCRIPTION OF THE PREFERRED EMBODIMENT

Figure 3:
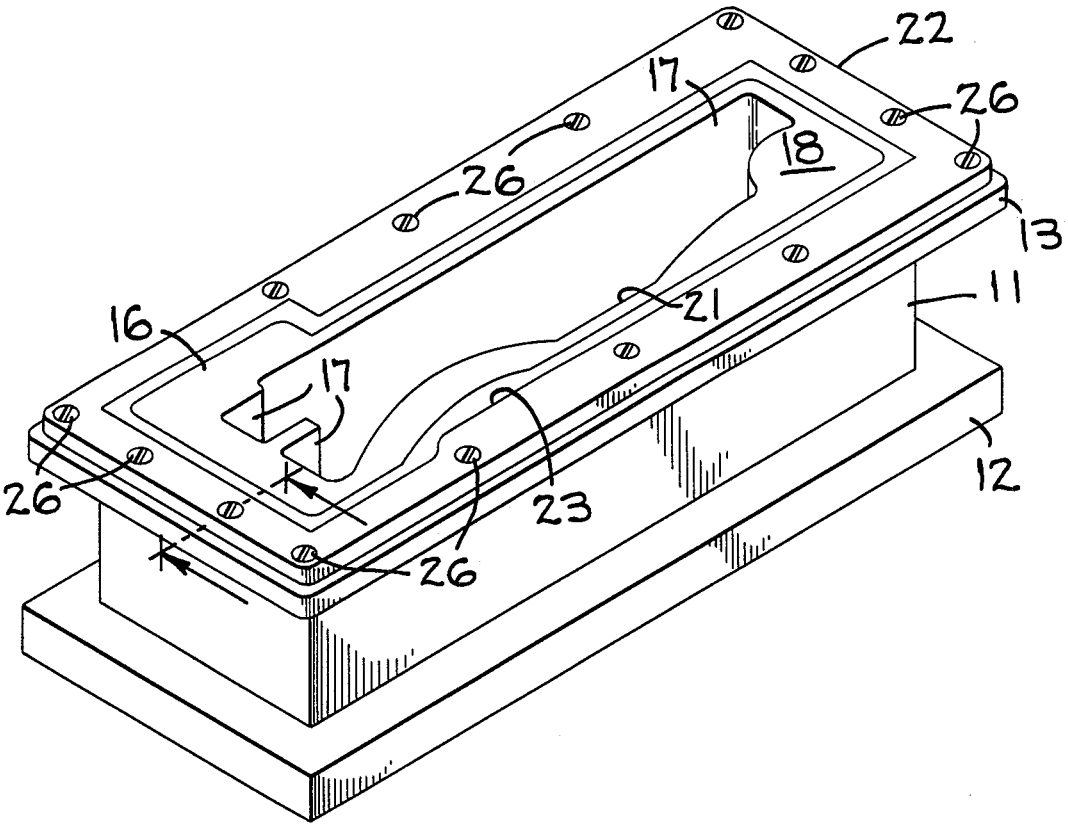
FIG. 3 is an isometric view combining the components of FIGS. 1 and 2.

A part of one type of core box assembly is shown in FIG. 2 wherein an outer aluminum body 11 has an enlarged base 12 at the bottom thereof to provide stability for the core box assembly to be described herein. A flange 13 runs around the upper portion of the core box body 11 extending laterally from the body and having a pattern of threaded holes 14 therethrough.

A plastic or a wooden portion 16 of the core box assembly is disposed within the core box body. A core depression is defined by a configuration of contiguous walls 17 formed within the plastic or wooden portion of the core box assembly. The upper surfaces of the core box body 11 and the plastic or wooden portion 16 are coplanar and form a strike-off surface 18 for the core box assembly. The periphery of the upper surface of the flange 13 is cut away to lie below the strike-off surface 18 as seen in FIG. 2. As a consequence a step 19 is formed at the upper extremity of the core box assembly which may be seen to completely surround an opening 21 in the strikeoff surface defined by the intersection of the walls 17 and the strike-off surface 18. The aluminum portion of the strike-off surface 18, which is seen to be the upper extremity of the core box body 11 in FIG. 2, and the plastic or wooden portion 16 of the strike-off surface are both made of relatively soft material which would be subject to wear or erosion if exposed to abrasive substances over a period of time.

FIG. 1 depicts a one piece strike-off member or plate 22 formed from a piece of steel plate which may be, by way of example, anywhere from one-half to three-eighths of an inch thick in the preferred embodiment. A centrally disposed opening 23 is cut in the strike-off member 22 wherein the opening has substantially the same shape as the step 19 seen in FIG. 2. A pattern of clearance holes 24 is formed in the strike-off member which are in substantially the same array as the pattern of threaded holes 14 in the upper flange 13 of the core box body 11. The thickness of the strike-off member is substantially the same as the height of the step 19. Consequently, the strike-off member may be lowered to rest atop the cutaway portion of the flange 13 and the clearance holes 24 will be in registration with the pattern of threaded holes 14.

Figure 4:
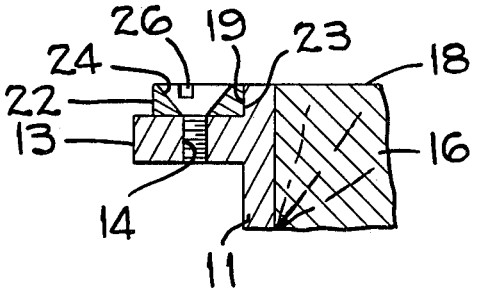
FIG. 4 is a fragmentary section taken along the line 4—4 of FIG. 3.

As may be seen with reference to FIG. 4, the clearance holes 24 are counter sunk so that they each may accept a flat head screw 26 as may also be seen in FIG. 3. The one piece steel strike-off member 22 is fastened securely in place with the boundaries of the opening 23 therein abutting the step 19. It may also be seen with reference to FIGS. 3 and 4 that, because the thickness of the strike-off member 22 is substantially the same as the height of the step 19, the strike-off surface 18 and the upper surface of the strike-off member are substantially in a flush or coplanar relationship.

The outer boundary of the strike-off member 22 may be seen to lie just within the outer boundaries of the flange 13 on the core box body 11. The interface between the boundaries of the opening 23 in the strike-off member and the step 19 in the strike-off surface 18 may be seen to lie just outside the outer boundaries of the plastic or wooden portion 16 of the core box assembly. The opening 23 is therefore seen to follow the configuration of the mold opening 21 in the core depression in only a very general manner. This reduces the complication of the shape of the opening 23 so that it is readily and inexpensively formed. While the opening 23 from the standpoint of good workmanship should follow the contour of the step 19, it needs only to mate approximately with the shape of the step 19 for the strike-off member to perform its intended function.

The strike-off member 22 may be seen to be a continuous or a one piece part which, when assembled in place as shown in FIGS. 3 and 4, provides a relatively hard and abrasion resistent surface flush with, or in the same plane as, the strike-off surface 18. The fasteners represented by the flat head screws 26 may be seen to be at or below the plane of the strike-off surface 18 so that no protrusions thereabove are present in the assembled core box. As a result a flat bar (not shown), termed a strike-off bar, may be laid flat across the strike-off surface after an overfill of mold sand and bonding compound has been deposited in the core depression defined by the contiguous walls 17, and moved across the top of the core box assembly guided by the upper surface of strike-off member 22 in the plane of the strike-off surface 18. The mold sand and bonding material (uncured) is thereby leveled at the plane of the strike-off surface and the core box is ready to be placed in an appropriate curing environment for the formation of the core from the mold sand and bonding material mixture contained in the core depression. Many cores may thus be serially fabricated in one core box by repeating the aforementioned overfilling with mold sand and bonding material mixture and the subsequent striking off of the overfill with the strike-off bar without eroding the strike-off surface 18 appreciably. The relatively soft strike-off surface 18 is protected by the relatively hard upper surface of the steel strike-off member 22 as it resists abrasion and erosion which would normally occur at the strike-off surface due to the interaction between the mold sand and the strike-off bar with the strike-off surface as the overfill is being removed from the top of the core box assembly.

As a result of the structure which includes the relatively hard strike-off member 22, the depth of the core depression defined by the walls 17 remains substantially constant over a much longer period of core box usage. This results because the relatively soft aluminum and plastic or wooden surfaces are protected as the surface of the strike-off member 22 bears the forces which would otherwise be exerted against the softer surfaces by the strike-off bar and the mold sand.

It should be noted that on occasion the core box body 11 is formed of wood. A core box assembly, including the wooden box body, step 19 and strike-off member 22, would function in accordance with the aforedescribed description of the invention. It should further be noted that due to the one piece or unitary construction of the strike-off member, there can be no "raising up" at any of the corners of the core box assembly in the strike-off member as may possibly occur if metal strips (four strips for the core box assembly seen in the Figures) were merely fastened to the edges of the core box assembly independently. Such "raising up" of the corners of separate strips of metal causes the strike-off bar to also be raised as it is passed across the mold opening 21, thereby providing other than a flat surface in the plane of the strike-off surface 18. As a consequence, when the core portion formed in the core depression defined by the walls 17 is placed with another core portion or portions defining the entire core, or is placed in position by itself within the mold, the flat surface of the core portion must be reworked to obtain a proper fit. It may be seen that the core may thus be diminished in the dimension corresponding to the depth of the core depression and the corresponding void in the end cast article will thereby be smaller than desired.

Although the best mode contemplated for carrying out the present invention has been herein shown and described, it will be apparent that modification and variation may be made without departing from what is regarded to be the subject matter of the invention.

What is claimed is:

1. A core box assembly, comprising a core box of a relatively soft material, a strike-off surface on said core box, said core box having a core depression therein adapted to receive a mold sand and forming a mold opening in said strike-off surface.

said strike-off surface having a recess therein surrounding and displaced laterally from the edges of said mold opening, a continuous strike-off member of a relatively hard material formed to fit within said recess, thereby surrounding said mold opening and lying substantially flush with said strike-off surface, whereby mold sand may be leveled at said mold opening with a strike-off bar which is guided by the upper surface of said strike-off member and erosion of said strike-off surface is substantially eliminated.

2. A core box assembly as in claim 1 wherein said core box material is aluminum.

3. A core box assembly as in claim 1 wherein said relatively soft material having a core depression therein comprises a wooden mold and said strike-off member comprises a flat steel plate having an opening surrounding said mold opening.

4. A core box assembly as in claim 1 wherein said relatively soft material having a core depression therein comprises a plastic mold and said strike-off member comprises a flat steel plate having an opening surrounding said mold opening.

5. A core box assembly as in claim 1 wherein said relatively soft material surrounding said core depression comprises a plastic mold and wherein the periphery of said core box and said strike-off surface comprises an aluminum box, said strike-off surface recess being formed in said aluminum portion of said strike-off surface.

6. A core box assembly as in claim 5 wherein said recess is a peripheral step in said strike-off surface and said strike-off member comprises a flat steel plate having an opening surrounding and having boundaries spaced from said mold opening.

7. A core box assembly wherein a core box of relatively soft material surrounds a core depression therein which is adapted to receive a mold sand and which forms an opening in a strike-off surface on the core box, comprising a continuous strike-off member formed of a relatively hard material and having an opening therethrough with opening boundaries greater than and spaced laterally from the boundaries of said core depression opening, said strike-off surface having a recess formed therein to receive said strike-off member so that the surface of said member is substantially in flush relationship with said strike-off surface surrounding said core depression opening and the surface of said member guides a strike-off bar passed thereover, whereby abrasion of the strike-off surface caused by leveling of the mold sand with the strike-off bar is inhibited.

8. A core box assembly as in claim 7 wherein said strike-off member comprises a steel plate surrounding said opening.

9. A core box assembly as in claim 7 wherein said continuous strike-off member comprises a one piece part fabricated from steel plate, and means for securely fastening said plate in position surrounding said core depression opening, whereby the core box is strengthened to resist core depression deformation.

* * * * *